United States Patent [19]

Haber

[11] 3,974,638

[45] Aug. 17, 1976

[54] HOURGLASS WATCH

[76] Inventor: Terry M. Haber, 3050 S. Bristol No. 8C, Santa Ana, Calif. 92707

[22] Filed: Sept. 4, 1975

[21] Appl. No.: 610,187

[52] U.S. Cl. ..... 58/50 R; 58/88 G; 58/144; 200/61.45 R; 200/61.47; 200/DIG. 18

[51] Int. Cl.[2] ..... G04B 19/30; G04B 37/08; G04F 1/06; H01H 35/02

[58] Field of Search ..... 58/144, 50 R, 88 R, 58/88 G; 200/DIG. 2, 61.45, DIG. 18, 61.47, 61.52, 184, 220

[56] References Cited

UNITED STATES PATENTS

| | | | |
|---|---|---|---|
| 3,707,842 | 1/1973 | Spivak | 58/144 |
| 3,742,699 | 7/1973 | Bergey | 58/50 R |
| 3,841,080 | 10/1974 | O'Donald | 58/33 |

*Primary Examiner*—E. S. Jackmon
*Attorney, Agent, or Firm*—Ralph B. Pastoriza

[57] ABSTRACT

A quartz-operated digital watch is provided with a casing defining a shallow cavity within which a chamber of hourglass configuration is disposed. This hourglass chamber includes gold dust or particles which, when caused to flow from one chamber portion to another, bridge two electrodes to complete a circuit and render the digital display visible.

6 Claims, 5 Drawing Figures

HOURGLASS WATCH

This invention relates generally to watches and more particularly to pocket watches or necklace supported pendant-watches of the digital read-out type wherein light-emitting diodes or liquid crystals provide the display and wherein a novelty feature is built-in in the form of an hourglass on the top surface of the watch casing.

BACKGROUND OF THE INVENTION

Quartz crystal watches have become very popular in the past year and generally provide a digital read-out either by means of light emitting diodes or liquid crystals.

In watches of the foregoing type, there is normally provided a manually operable push-button which will actuate an illuminating means within the watch to render the display visible. Operation of this push-button occupies both hands of the wearer, one hand or wrist supporting the watch or holding the watch and the other hand operating the push-button. Because of this awkward procedure, inertia type switches which can respond to a flick of the wrist have been utilized in such watches to render the display visible. In other instances, pressure switches which can be operated by the one hand or wrist supporting the watch have also been proposed. See, for example, my copending U.S. patent applications Ser. Nos. 156,688 filed Oct. 21, 1974 entitled ACTUATING MECHANISMS FOR WRIST INSTRUMENTS; 556,335 filed Mar. 7, 1975, entitled WRIST ACTUATED PRESSURE SWITCH FOR WATCHES; and 538,743 filed Jan. 6, 1975, entitled ACCELERATION/DECELERATION ACTUATING MECHANISM FOR WRIST INSTRUMENTS.

While the inertia responsive switch works well for a wristwatch since a wearer need only flick his wrist, it might not be as convenient in the case of a pocket watch or watch hanging from a necklace in the manner of a pendant.

BRIEF DESCRIPTION OF THE PRESENT INVENTION

With the foregoing in mind, the present invention contemplates a novel actuating means for rendering the display of a digital type pocket watch or watch arranged to be hung from a necklace visible. In this respect, considerable attraction to the watch is provided by utilizing an hourglass principle for effecting the desired actuation.

More particularly, in accord with the invention, a watch casing incorporating battery means defines a shallow cavity in its top exterior surface. The watch display is in the central portion of the cavity and provides a digital indication of the time when appropriately rendered visible by suitable actuating means within the casing. A closed chamber of hourglass configuration is disposed in the cavity and incorporates electrically conducting granules; for example, gold dust. At the constricted central portion of the hourglass there are provided two opposed electrodes which connect to the battery means in the cavity and to suitable actuating means for rendering the display visible, the actuating means being actuated upon electrical bridging of the electrodes.

With the foregoing arrangement, the flow of conducting granules from one portion of the hourglass to another as by properly orienting the watch casing results in an electrical bridging of the electrodes at the constricted portion, thereby closing a circuit to render the display visible.

The provision of the hourglass configuration on the face of the watch casing is an attractive feature and moreover serves the desired function of illuminating the display.

BRIEF DESCRIPTION OF THE DRAWINGS

A better understanding of this invention will be had by referring to one embodiment thereof as illustrated in the accompanying drawings in which.

DETAILED DESCRIPTION OF THE INVENTION

Figure 1:
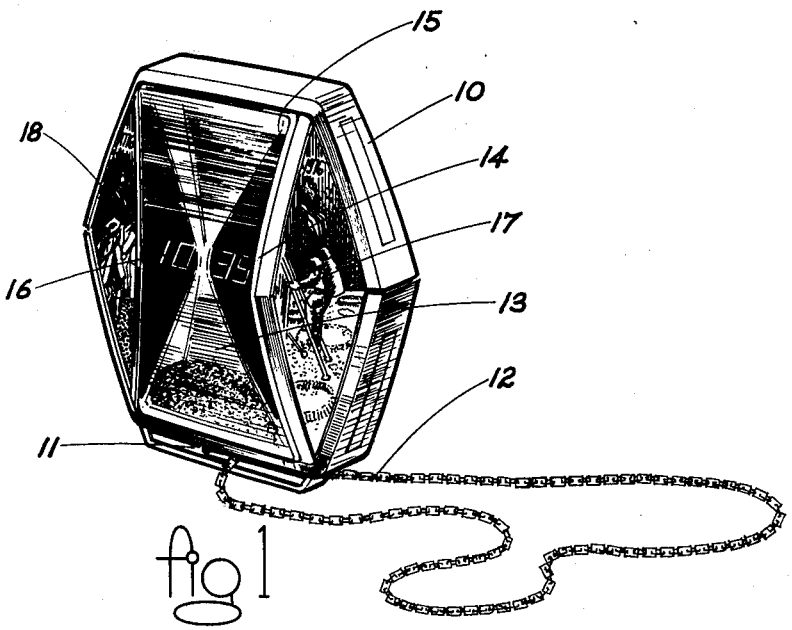
FIG. 1 is a perspective view of an hourglass watch in accord with the present invention.

Referring first to FIG. 1, there is shown a digital watch including a watch casing 10. At the central bottom portion of the casing 10 there is provided an eye 11 to which a chain or suitable necklace such as indicated at 12 may be secured. It will be understood in the embodiment to be described that the watch is essentially a pocket watch or a watch of the type that may be hung from a necklace in a manner similar to a pendant.

As shown in FIG. 1 there is provided on the top surface of the casing 10 a closed chamber 13 of hourglass configuration covered by an outer crystal 14 and disposed in a cavity 15 formed in the top surface of the casing 10. The watch display is also disposed in the cavity 15 in a central area as indicated at 16, certain of the digits displayed being symmetrically disposed on either side of the central constricted portion of the hourglass configuration 13.

The novelty of the appearance of the watch may be further enhanced by the provision of medallion like depictions of historical events, such as indicated at 17 and 18 illustrating man's first step on the moon and the first Minuteman soldier, respectively. These medallion like showings can be formed in relief on opposite sides of the hourglass configuration 13.

Figure 2:
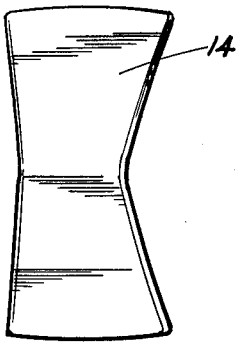
FIG. 2 is an exploded view of the watch of FIG. 1 showing basic elements supported in the top exterior portion of the watch casing.
Figure 2:
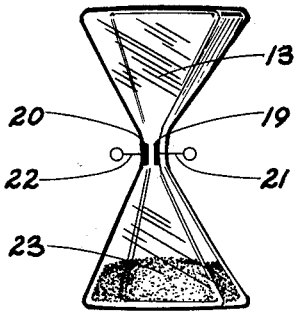

Referring now to the exploded view of FIG. 2, the cavity 15 in the top surface of the watch casing 10 is clearly evident, the chamber in the form of an hourglass at 13 being shown exploded away from the cavity. The cover crystal glass 14 in turn is illustrated further exploded from the hourglass 13.

With specific reference to the hourglass 13, it will be noted that electrodes 19 and 20 are provided in opposed relationship within the constricted central portion of the hourglass. These electrodes connect by way of leads 21 and 22 to appropriate battery means and illuminating means within the casing such that when the electrodes are electrically bridged; that is, electrically connected together, the illuminating means will be actuated to render the display 16 visible. In this respect, bridging of the electrodes 19 and 20 accomplishes the same function as operation of the normally provided manual push-button switch for rendering the digital display visible.

As illustrated in FIG. 2, the closed chamber of hourglass configuration 13 incorporates electrically conducting granules 23 which will flow from one chamber portion to the other under gravity when the entire watch casing is inverted or returned to an upright position after being held in an inverted position.

In the preferred embodiment of the invention, the conducting granules 23 take the form of gold dust or particles. Regardless of the particular material provided that the same is conductive, when the granules flow past the constricted central portion of the hourglass configuration the electrodes 19 and 20 will be electrically bridged thereby triggering the illuminating means within the watch casing by actuating the same to render the digital display visible.

The purpose for providing the supporting eye 11 shown in FIGS. 1 and 2 at the bottom central portion of the watch casing will now be clear. Thus, when the watch is received in a person's pocket, it will be disposed in the watch pocket upside down so that the eye 11 is towards the top. Alternatively, if the watch is hung from a necklace in the manner of a pendant, it will be normally in an upside down position. Accordingly, in either instance, the gold dust or conducting granules will flow to the upper chamber of the hourglass which is in a downward position when the watch is upside down. When a person removes the watch from his pocket and inverts it to observe the digital read-out, the flow of the particles will thus take place from the now positioned upper chamber to the lower chamber to render the display visible. The same situation will obtain if a person wearing the watch as a pendant lifts the watch up to observe the digital display.

It is important that the electrodes not be bridged when the watch is in a stored position or simply being carried by the person as otherwise there would be a continuous drain on the battery in the watch. This problem is avoided by proportioning the quantity of conductive particles or gold dust relative to the total volume of the chamber of hourglass configuration.

Figure 3:
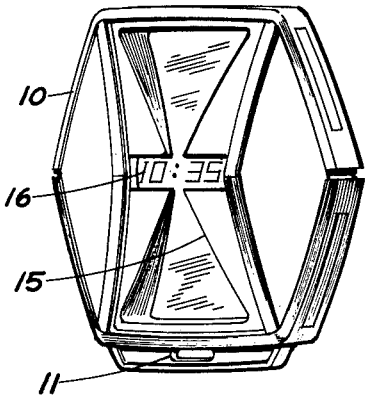
FIG. 3 is a schematic showing of the chamber configured in the shape of an hourglass utilized in FIG. 2 in a first position.
Figure 3:
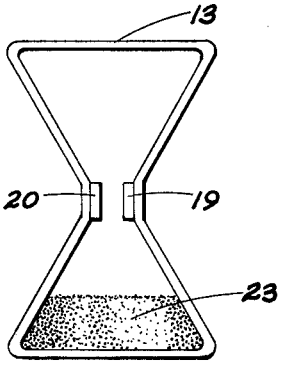
Figure 4:
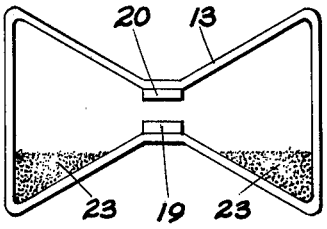
FIG. 4 is a view similar to FIG. 3 illustrating the chamber rotated 90°; and, FIG. 5 is a simple block diagram of the illuminating means for the display of the watch of FIGS. 1 and 2.

The foregoing will become clearer by referring to FIGS. 3 and 4 wherein the chamber 13 is shown in one upright position wherein the conducted particles 23 are collected in the lower portion of the chamber thus completely free and clear of the electrodes 19 and 20 so that no bridging will take place when the watch is held in this position.

Should the watch be tilted or rotated 90° to thus position the hourglass configuration 13 as shown in FIG. 4 on its side, the conducting particles 23 will collect in the lower portions of the opposite parts of the hourglass and still avoid any short circuiting or bridging of the electrodes 19 and 20. It will be appreciated accordingly that the only manner in which electrodes 19 and 20 can be electrically bridged is to purposefully cause a flow of the conducting particles through the constricted central portion of the hourglass configuration.

Figure 5:
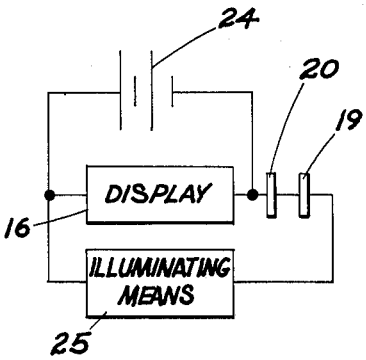

Referring now to FIG. 5 there is shown a simple block diagram of certain of the components with which the present invention is concerned. Thus, a suitable battery means 24 is incorporated in the casing for energizing the display 16. An illuminating means 25 in turn is arranged to render the display 16 visible when actuated. Actuation of the illuminating means is accomplished by connecting the same to the battery 24 and in accord with this invention, such connection is accomplished by bridging the electrodes 19 and 20 described in conjunction with FIG. 2 and schematically illustrated in FIG. 5. Thus, the electrodes 19 and 20 are in series with the illuminating means 25 and battery means 24 such that when the electrodes are bridged, the illuminating means will be actuated to render the display 16 visible.

From the foregoing description, it will be evident that the present invention has provided a novel means for actuating the normally provided illuminating means in digital type watches, particularly suitable for pocket watches or watches of the type that may be suspended from a necklace. In addition, the actuating means in the form of the hourglass configuration incorporating conducting particles presents a novel and ornamental aspect rendering the watch extremely attractive.

An important feature of the foregoing described hour glass configuration is the fact that the flowing conductive particles maintain the surfaces of the opposing electrodes clean and free of contamination. Further, by providing the conductive particles in the form of micro-spheroids, such as gold micro-spheroids as opposed to gold dust, plastic material can be used for the hourglass chamber without abrasive degradation of its interior surfaces or visual fogging and/or loss of transparency.

It will be appreciated that the normally provided manually operable switch could also be utilized for rendering the display visible. Further, it should be understood that while the preferred embodiment of the present invention is for pocket watches or watches to be suspended from a necklace, the configuration could be utilized for a wristwatch instrument if desired.

What is claimed is:

1. An hourglass watch including, in combination:

a. a watch casing incorporating battery means and defining a shallow cavity in its top exterior surface;

b. display means in said cavity for providing a digital indication of the time;

c. illuminating means in said casing for rendering visible said display means when actuated;

d. a closed chamber of hourglass configuration disposed in said cavity and incorporating electrically conducting granules; and, e. electrodes connected to said battery means and to said illuminating means to actuate said illuminating means when electrically bridged, said electrodes being in opposed relationship in the constricted central portion of said hourglass in positions to be electrically bridged together by the flow of said granules under gravity from one portion of the closed chamber to the other portion, whereby said illuminating means may be actuated by holding said watch casing in a position to cause the granules to flow past said constricted portion of the hourglass under the influence of gravity.

2. An hourglass watch according to claim 1, in which said digital display is located on either side of the constricted central portion of said hourglass and is in a right side up position when said watch casing is brought into a viewing position from a normal storing position in which the display is upside down, whereby when the watch casing is normally stored, the granules in the hourglass migrate to that portion of the hourglass which will be physically above the other portion when the watch is inverted for viewing so that a flow of granules through said constricted portion to bridge said electrodes is assured when the watch is to be viewed.

3. An hourglass watch according to claim 1, in which said conducting granules constitute gold dust.

4. An hourglass watch according to claim 1, in which said conducting particles are provided in the form of micro-spheroids.

5. An hourglass watch according to claim 1, in which side portions of said watch casing adjacent the sides of said cavity include medallion ornamentations in relief depicting historical scenes.

6. An hourglass watch according to claim 1, in which said watch casing includes an eye portion for connection to a chain or necklace at its central bottom end when the watch is held in a position to read the display in a right side up position such that when the watch is hung from a chain or necklace by said eye, it will assume an upside down position causing said conductive granules in said hourglass to migrate towards one end portion of said chamber.

* * * * *